US008029310B2

(12) United States Patent
Shindo et al.

(10) Patent No.: US 8,029,310 B2
(45) Date of Patent: Oct. 4, 2011

(54) CONNECTOR

(75) Inventors: Satoru Shindo, Nishikamo-gun (JP); Yuji Miyazaki, Nishikamo-gun (JP); Hiroshi Kobayashi, Toyota (JP)

(73) Assignees: J.S.T. Mfg. Co., Ltd., Osaka-shi (JP); Toyota Jidosha Kabushiki Kaisha, Toyota-shi (JP)

( * ) Notice: Subject to any disclaimer, the term of this patent is extended or adjusted under 35 U.S.C. 154(b) by 230 days.

(21) Appl. No.: 12/440,926

(22) PCT Filed: Sep. 11, 2007

(86) PCT No.: PCT/JP2007/067624

§ 371 (c)(1),
(2), (4) Date: Mar. 12, 2009

(87) PCT Pub. No.: WO2008/032690

PCT Pub. Date: Mar. 20, 2008

(65) Prior Publication Data

US 2009/0325416 A1 Dec. 31, 2009

(30) Foreign Application Priority Data

Sep. 15, 2006 (JP) ..... 2006-250633

(51) Int. Cl.
*H01R 13/64* (2006.01)

(52) U.S. Cl. ..... 439/374; 439/350; 439/680

(58) Field of Classification Search ..... 439/349, 439/347, 350, 677, 680, 681, 374
See application file for complete search history.

(56) References Cited

U.S. PATENT DOCUMENTS

| | | | | |
|---|---|---|---|---|
| 5,120,233 | A * | 6/1992 | Mikola | 439/349 |
| 5,823,813 | A * | 10/1998 | Dye | 439/347 |
| 6,332,800 | B2 * | 12/2001 | Kodama | 439/357 |
| 7,794,288 | B2 | 9/2010 | Shindo et al. | |
| 2001/0027049 | A1 * | 10/2001 | Kato et al. | 439/374 |

FOREIGN PATENT DOCUMENTS

| | | |
|---|---|---|
| JP | 62-152379 | 9/1987 |
| JP | 62 152379 | 9/1987 |
| JP | 63-179675 | 11/1988 |
| JP | 63 179675 | 11/1988 |
| JP | 5-43483 | 6/1993 |
| JP | 5 43483 | 6/1993 |
| JP | 2004 171911 | 6/2004 |
| JP | 2006 202557 | 8/2006 |

OTHER PUBLICATIONS

U.S. Appl. No. 12/089,121, filed Apr. 3, 2008, Shindo, et al.

* cited by examiner

*Primary Examiner* — Felix O Figueroa
(74) *Attorney, Agent, or Firm* — Oblon, Spivak, McClelland, Maier & Neustadt, L.L.P.

(57) ABSTRACT

In an electrical connector, a female housing is made to mate with a male housing. The female housing has guide ways each formed perpendicularly to a direction of mating of the male housing with the female housing. In the guide ways, a latch metal is disposed. The guide ways of the female housing respectively have opening portions from each of which the corresponding latch part of the latch metal is capable of projecting toward the male housing. When the male housing is inserted into the female housing, the latch parts are respectively projected from the opening portions of the female housing toward the male housing. The latch parts are respectively locked at predetermined inclined planes a formed on the male housing.

5 Claims, 8 Drawing Sheets

CONNECTOR

TECHNICAL FIELD

The present invention relates to a connector capable of performing electrical continuity even in a harsh environment.

BACKGROUND ART

In recent years, in a power source (for example, an engine) used for a vehicle such as an automobile, various electronic controls have been used in order to address issues such as fuel savings, emission control, or the like. In order to perform these electronic controls, a sensor, an actuator, a control device (for example, an electronic control unit: ECU), cables and electrical connectors for connecting equipment, and the like are mainly required.

However, in the vicinity of a power source, in particular, a direct fuel-injection engine or the like, electrical connectors thereof are placed in a harsh environment. That is, because high-acceleration vibration is caused in the vicinity of such a power source, housings of the electrical connectors are easily worn away or made defective, which makes it difficult to maintain the durability of the electrical connectors. Further, when high-acceleration vibration of a power source corresponds to a natural frequency of an electrical connector itself, the electrical connector itself falls into a mechanical resonance condition, which makes it further difficult to maintain the durability thereof.

Therefore, when an electrical connector is used in an environment in which high-acceleration vibration is caused, a leader cable has been used to lead out the electrical connector to a place on which there is less effect of high-acceleration vibration so that the electrical connector can be operated in that place, and to make transmission back to the environment in which high-acceleration vibration is caused.

However, installation of an electrical connector by use of a leader cable results in an increase in the number of components. As a result, spaces are produced among the junctions of the respective components, which cause a reduction in the vibration resistance of the electrical connector.

Further, in a connector which has been disclosed (refer to Patent Document 1), it is necessary to insert a spacer after mating of the connector, a plurality of connecting processes are required for connecting the connector. Therefore, the greater the number of connectors to be installed becomes, the greater the increase in man-hours for connection. Patent Document 1: Japanese Published Unexamined Patent Application No. 2004-171911.

DISCLOSURE OF THE INVENTION

It is an object of the present invention to provide a connector capable of being simply and easily connected without loss of electrical continuity even in a harsh environment.

It is another object of the present invention to provide a connector which has resistance to high-acceleration vibration, and is lightweight and capable of being downsized.

(1) A connector according to the present invention includes: a female-type first housing supporting a first joining terminal; a male-type second housing supporting a second joining terminal electrically connected to the first joining terminal, the second housing being inserted into the first housing to mate with the first housing; and a latch metal latched into a groove which extends in one direction perpendicular to a direction of mating of the first housing and the second housing and is formed in the first housing, the latch metal having a projection shaped latch part which is urged against the second housing in a direction perpendicular to both of the direction of mating and a direction of the groove, in which connector: the first housing has, in the groove, an opening portion from which the latch part of the latch metal is capable of projecting toward the second housing for locking; the second housing has a predetermined inclined plane which locks, at the time of mating of the first housing and the second housing, the latch part of the latch metal projecting from the opening portion of the first housing; and the latch metal is an elastic member, and is configured so that, at the time of mating of the second housing with the first housing, the latch part projects from the opening portion and contacts the predetermined inclined plane due to elastic force.

In the connector of the present invention, the first housing is made to mate with the second housing. The first housing has the groove formed perpendicularly to the direction of mating of the second housing with the first housing. In the groove, the latch metal is disposed. The groove of the first housing has the opening portion from which the latch part of the latch metal is capable of projecting toward the second housing. When the second housing is inserted into the first housing, the latch part is projected from the opening portion of the first housing toward the second housing. The latch part is locked at the predetermined inclined plane formed on the second housing.

In this structure, the latch metal is locked in the groove of the first housing, and therefore the latch metal is integrated with the first housing. In addition, the latch part of the latch metal projects, with elastic force, from the opening portion of the first housing toward the second housing. As a result, when the second housing is inserted into the first housing, the latch part of the latch metal is locked at the predetermined inclined plane formed on the second housing. Therefore, even when the mating of the first housing and the second housing is changed over time, it is possible to keep the latch part locked by a distance corresponding to the length of the predetermined inclined plane since the latch metal is locked at the predetermined inclined plane. Accordingly, it is possible to cancel out an effect caused by an error or a permissible dimensional deviation. As a result, the connector is capable of maintaining the integrity for a long time even when there is an error or a permissible dimensional deviation, and providing stable continuity for a long time.

(2) The predetermined inclined plane is configured so that, even when the first housing and the second housing are formed to have a permissible dimensional deviation, or changed over time, the latch part projects from the opening portion and contacts the predetermined inclined plane due to an elastic force, at the time of mating of the first housing with the second housing.

In this structure, the predetermined inclined plane is formed in consideration of: a mating depth in a state where a permissible dimensional deviation during formation or deviation due to a change over time is at a maximum; and a mating depth in a state where such deviation is at a minimum. As a result, the elastic force is always applied to the predetermined inclined plane. Accordingly, the connector is capable of maintaining the integrity for a long time, and providing stable continuity for a long time.

BEST MODE FOR CARRYING OUT THE INVENTION

Hereinafter, an embodiment according to the present invention will be described. In the embodiment, an electrical connector will be explained with an example of a connector.

One Embodiment

Figure 1:
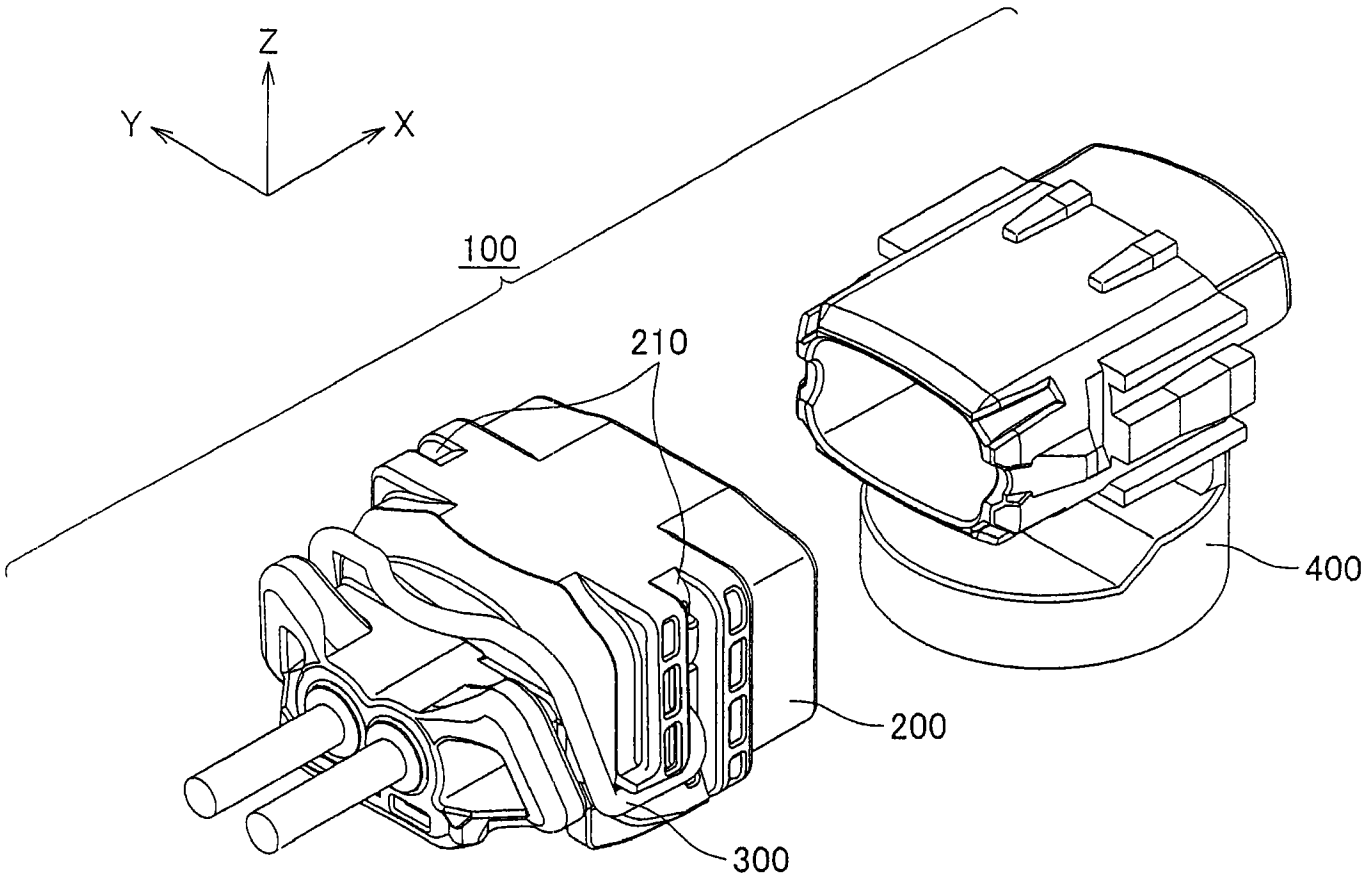
FIG. 1 is a schematic perspective view showing one example of an electrical connector according to one embodiment of the present invention.

FIG. 1 is a schematic perspective view showing one example of an electrical connector 100 according to one embodiment of the present invention.

As shown in FIG. 1, the electrical connector 100 according to the present embodiment includes a female housing 200, a latch metal 300, and a male housing 400.

As shown in FIG. 1, the female housing 200 has guide ways 210 provided in a direction parallel to a direction (a direction of an arrow Z in the drawing) perpendicular to a direction in which the female housing 200 and the male housing 400 are made to mate with one another (a direction of an arrow X in the drawing). The latch metal 300 is pressed (from the direction of the arrow Z toward the direction of −Z) to fit into the guide ways 210 of the female housing 200.

A pair of first joining terminals 201*a* and 201*b* (refer to FIG. 2) are provided inside the female housing 200 of FIG. 1. In the same way, a pair of second joining terminals 401*a* and 401*b* (refer to FIG. 3) are provided inside the male housing 400 of FIG. 1.

On the other hand, electrical wirings are connected to the second joining terminals 401*a* and 401*b* provided inside the male housing 400 (refer to FIG. 3).

The details will be described later. Due to the male housing 400 being inserted to mate with the female housing 200, the first joining terminal 201*a* and the second joining terminal 401*a*, and the first joining terminal 201*b* and the second joining terminal 401*b* are respectively joined to achieve electrical continuity.

Next, the shapes of the female housing 200 having the latch metal 300 and the male housing 400 will be described in detail. Then, a state in which the male housing 400 is inserted to mate with the female housing 200 having the latch metal 300 will be described.

FIG. 2 is a schematic view for explanation of the shape of the female housing 200 having the latch metal 300. FIG. 2A shows a front view of the female housing 200, FIG. 2B shows a top view of the female housing 200, FIG. 2C shows a side view of the female housing 200, and FIG. 2D shows an appearance perspective view of the female housing 200.

The female housing 200 shown in FIG. 2 has a substantially square tubular shape externally enwrapping a substantially square tubular shape of the male housing 400 which will be described later (refer to FIG. 3).

Figure 2A:
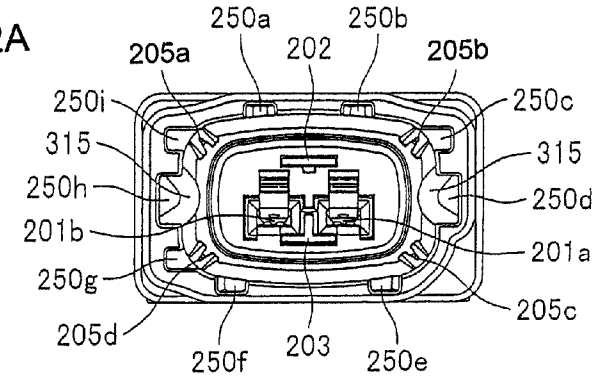
FIGS. 2A-2D are schematic views for explanation of a shape of a female housing having a latch metal.

As shown in FIG. 2A, the first joining terminals 201*a* and 201*b* are provided inside the female housing 200. The number of poles of the electrical connector 100 according to the present embodiment is two. Therefore, the first joining terminals 201*a* and 201*b* are provided side by side.

As shown in FIG. 2A, a rectangular rib 202 and a T-rib 203 are formed inside the female housing 200. Tapered shapes are respectively formed as these rectangular rib 202 and T-rib 203. The tapered shapes are provided for facilitating smooth insertion of the second joining terminals 401*a* and 401*b* of the male housing 400 (described later) into the first joining terminals 201*a* and 201*b* respectively, and for achieving a tight fit between the rectangular rib 202 and the T-rib 203, and a rectangular slit 402 and a T-slit 403 of the male housing 400 which will be described later, at the time of mating.

Moreover, the shapes of these rectangular rib 202 and T-rib 203 are provided for preventing inverse-mating of the male housing 400 and the female housing 200. That is, this is because the rectangular rib 202 and the T-slit 403 do not mate with one another, and the T-rib 203 and the rectangular slit 402 do not mate with one another. Further, the shapes of these rectangular rib 202 and T-rib 203 have a torsion-proof effect centering on the direction of the arrow X. The details of the torsion-proof will be described later.

Further, as shown in FIG. 2A, slit ribs 205*a*, 205*b*, 205*c*, and 205*d* are provided on the four corners of the female housing 200. These slit ribs 205*a*, 205*b*, 205*c*, and 205*d* are provided so as to contact slits 405*a*, 405*b*, 405*c*, and 405*d* of the male housing 400 at the time of completion of the mating of the female housing 200 and the male housing 400 which will be described later. The details of couplings of these slit ribs 205*a*, 205*b*, 205*c*, and 205*d*, and the slits 405*a*, 405*b*, 405*c*, and 405*d* will be described later.

Moreover, slits 250*a* and 250*b* are provided on one plane of the planes of the female housing 200, slits 250*c* and 250*d* are provided on another plane, slits 250*e* and 250*f* are provided on yet another plane, and slits 250*g*, 250*h*, and 250*i* are provided on the other plane.

These slits 205*a* to 205*i* are provided so as to contact ribs 450*a* to 450*i* of the male housing 400 at the time of completion of the mating of the female housing 200 and the male housing 400 which will be described later.

Further, tapered shapes whose width is narrowed outward from the center are provided to these ribs 205*a*, 205*b*, 205*c*, and 205*d*, and the slits 250*a* to 250*i*. The details of the tapered shapes will be described later.

Figure 2B:
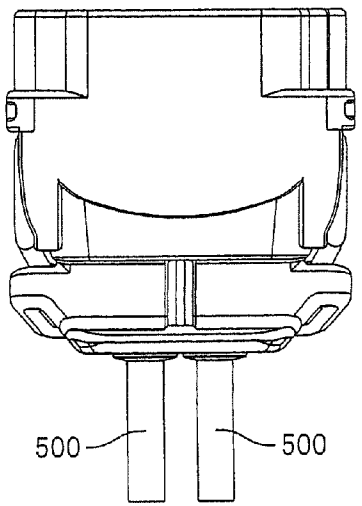
Figure 2C:
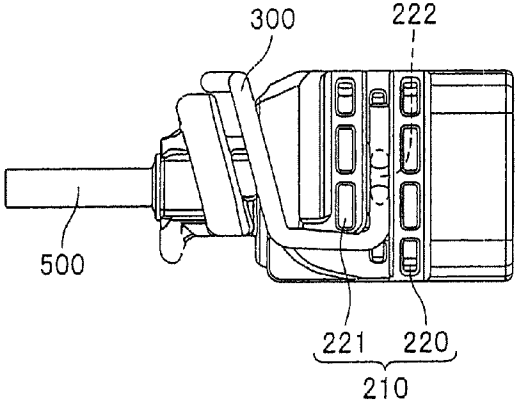

Next, as shown in FIG. 2C, the guide ways 210 are formed in a direction parallel to the direction of the arrow Z (refer to FIG. 1) on the side faces of the female housing 200. The guide ways 210 respectively include upstanding walls 220 and 221 and opening portions (through-holes) 222. Further, the opening portions 222 are provided in the substantially central parts of the guide ways 210.

Next, as shown in FIGS. 2B and 2C, cables 500 connected to the first joining terminals 201*a* and 201*b* (refer to FIG. 2A) are led out to the end of the female housing 200 in the direction of the arrow X (refer to FIG. 1).

Further, the latch metal 300 provided to the female housing 200 in FIG. 2 is composed of metal having spring force. For example, the latch metal 300 is formed from a metal material such as spring steel or a stainless steel. Further, in accordance with a state of use of the latch metal 300, coating processing and the like may be applied thereto. For example, when an attempt is made to improve the weather resistance or the corrosion resistance of the latch metal 300, galvanization, paint application, chromate treatment, or the like is applied thereto.

Figure 2D:
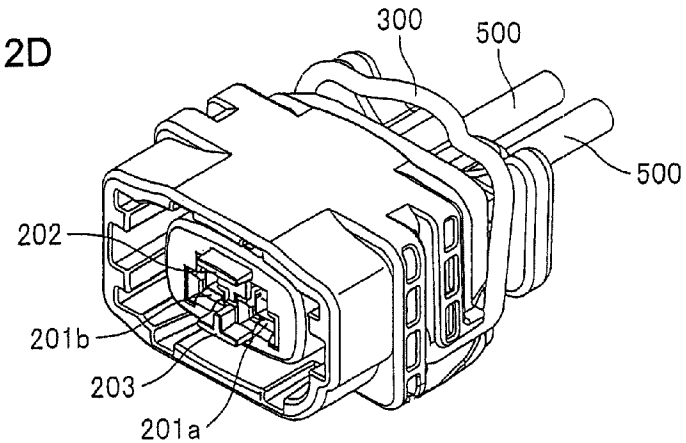

Further, as shown in FIG. 2D, the latch metal 300 is formed by inflecting one member whose cross section has a substantially circular form. To the latch metal 300, latch parts 315 (refer to FIG. 2A) are provided, which are formed to be curved into the above-described opening portions 222 so as to have elasticity in the direction of the center of the female housing 200.

The latch metal 300 is provided to be slidable in the direction of the arrow Z along the guide ways 210 of the female housing 200. When the latch metal 300 is made to slide in the direction of the arrow Z, the latch parts 315 (refer to FIG. 2A or FIG. 4) provided so as to project from the opening portions 222 of the guide ways 210 toward the central part of the female housing 200 move along the guide ways 210 not to project from the opening portions 222. The details of this movement will be described later.

Next, FIG. 3 is a schematic view for explanation of the shape of the male housing 400. FIG. 3A shows a front view of the male housing 400, FIG. 3B shows a top view of the male housing 400, FIG. 3C shows a side view of the male housing 400, and FIG. 3D shows an appearance perspective view of the male housing 400.

The male housing 400 shown in FIG. 3 has a substantially square tubular shape internally enwrapped by the substantially square tubular shape of the female housing 200 described above.

Figure 3A:
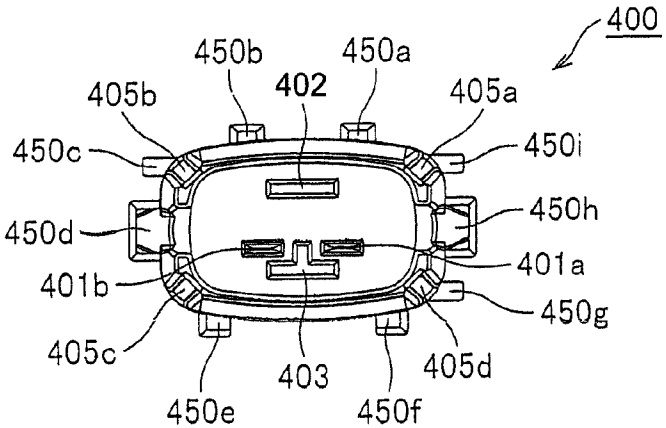
FIGS. 3A-3D are schematic views for explanation of a shape of a male housing.

As shown in FIG. 3A, the second joining terminals 401*a* and 401*b* are provided inside the male housing 400. In the same way as the first joining terminals of FIG. 2A, the number of the poles of the electrical connector 100 according to the present embodiment is two. Therefore, the second joining terminals 401*a* and 401*b* are provided side by side. At the time of mating of the male housing 400 and the female housing 200, the second joining terminal 401*a* is connected to the first joining terminal 201*a* of FIG. 2, and the second joining terminal 401*b* is connected to the first joining terminal 201*b* of FIG. 2.

As shown in FIG. 3A, the rectangular slit 402 and the T-slit 403 are formed inside the male housing 400. Tapered shapes are formed as these rectangular slit 402 and T-slit 403. The tapered shapes are provided for facilitating smooth insertion of the second joining terminals 401*a* and 401*b* into the first joining terminals 201*a* and 201*b* of the female housing 200 respectively, and for achieving a tight fit between the rectangular slit 402 and the T-slit 403, and the rectangular rib 202 and the T-rib 203 at the time of mating.

Moreover, the rectangular slit 402 and T-slit 403 are provided so as to have different shapes for preventing inverse-mating of the male housing 400 and the female housing 200. Further, by providing the rectangular slit 402 and the T-slit 403, it is possible to improve the resistance characteristic in a direction of torsion at the time of mating of the female housing 200 and the male housing 400.

Further, as shown in FIG. 3A, the slits 405*a*, 405*b*, 405*c*, and 405*d* are provided on the four corners of the male housing 400. The slits 405*a*, 405*b*, 405*c*, and 405*d* are provided so as to contact the slit ribs 205*a*, 205*b*, 205*c*, and 205*d* inside the female housing 200 at the time of completion of the mating of the male housing 400 and the female housing 200.

Moreover, the ribs 450*a* and 450*b* are provided on one plane of the planes of the male housing 400, ribs 450*c*, 450*d*, and 450*e* are provided on another plane, ribs 450*f* and 450*g* are provided on yet another plane, and ribs 450*h* and 450*i* are provided on the other plane. These ribs 450*a* to 450*i* are provided so as to contact the slits 250*a* to 250*i* of the female housing 200 at the time of completion of the mating of the male housing 400 and the female housing 200.

Further, tapered shapes whose width is narrowed outward from the center are provided as these slits 405*a*, 405*b*, 405*c*, and 405*d*, and the ribs 450*a* to 450*i*.

In the present embodiment, the slits 405*a*, 405*b*, 405*c*, and 405*d* are provided on the four corners of the male housing 400, and the ribs 450*a* to 450*i* are provided on the respective planes, and the ribs 205*a*, 205*b*, 205*c*, and 205*d* are provided on the four corners of the female housing 200, and the slits 250*a* to 250*i* are provided on the respective planes. However, these are not limited, and any rib and any slit may be provided at the portions of mating of the male housing 400 and the female housing 200.

Further, the shapes of these ribs and slits are not limited to the above-described tapered shape, and may be any other shape that achieves a tight fit by contacting at the time of mating of the male housing 400 and the female housing 200.

Figure 3B:
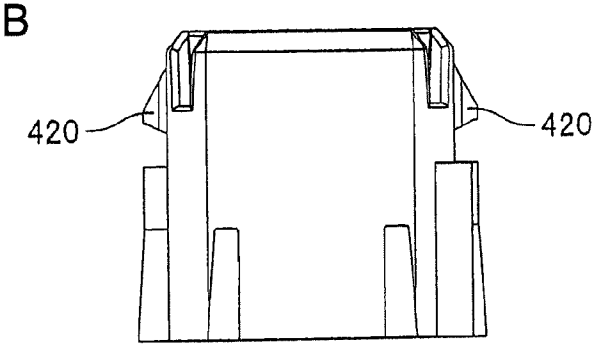
Figure 3C:
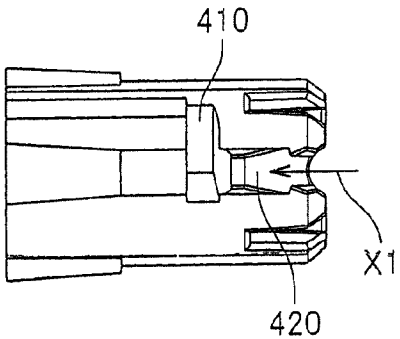
Figure 3D:
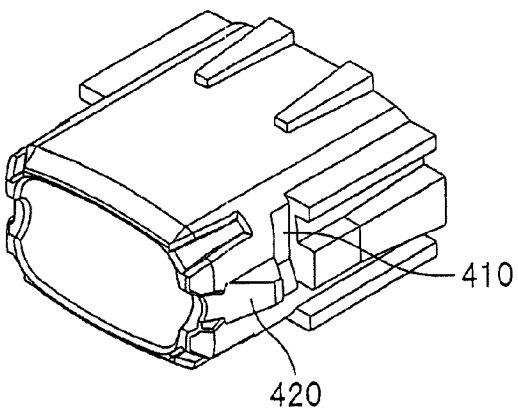

Next, as shown in FIGS. 3C and 3D, the fixation slits 410 are formed in a direction parallel to the direction of the arrow Z (refer to FIG. 1) in the male housing 400. The fixation slits 410 are formed from slits in each of which a substantially V-form is formed on a cross section parallel to the plane Y-Z, and are formed such that one inclination of the substantially V-form is gradual, and the other inclination is sharp. That is, the substantially V-form is formed into a state in which the latch metal 300 is easily moved in the direction of Z, and is hard to be moved in the direction of −Z.

Further, projection shaped parts 420 are provided in a direction of an arrow X1 from the end of the male housing 400 toward the fixation slits 410.

As shown in FIG. 3B, the projection shaped parts 420 are formed into a substantially trapezoidal shape on a cross section taken along plane X-Y. Here, at the time of mating of the female housing 200 having the latch metal 300 and the male housing 400, the latch parts 315 projecting from the opening portions 222 of the female housing 200 move in the direction of the arrow X1 on the planes of the projection shaped parts 420 shown in FIG. 3C, and climb over the projection shaped parts 420 to slip down to the fixation slits 410. In this case, the latch parts 315 are sunk down in the fixation slits 410 by the elastic force of the latch metal 300. Further, when an operator presses the latch metal 300 down in the direction of −Z, the latch parts 315 move along the sides of the projection shaped parts 420 at the time of mating of the male housing 400 and the female housing 200, and when the operator stops pressing the latch metal 300 down in the direction of −Z, the latch parts 315 move in the direction of Z to slip down to the fixation slits 420. In accordance therewith, it is possible to carry out mating of the male housing 400 and the female housing 200 smoothly.

Next, FIG. 4 is a schematic cross-sectional view for explanation of details after the latch parts 315 mate with the fixation slits 410.

Figure 4A:
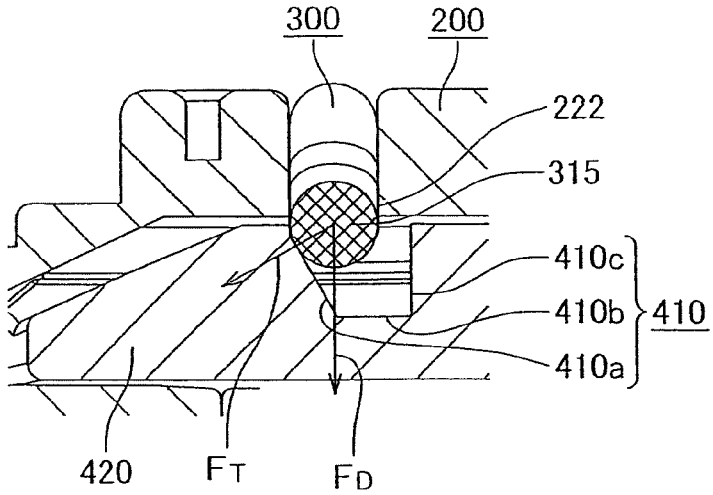
FIGS. 4A-4C are schematic cross-sectional views for explanation of details when a latch part of the latch metal is made to mate with a fixation slit.
Figure 4B:
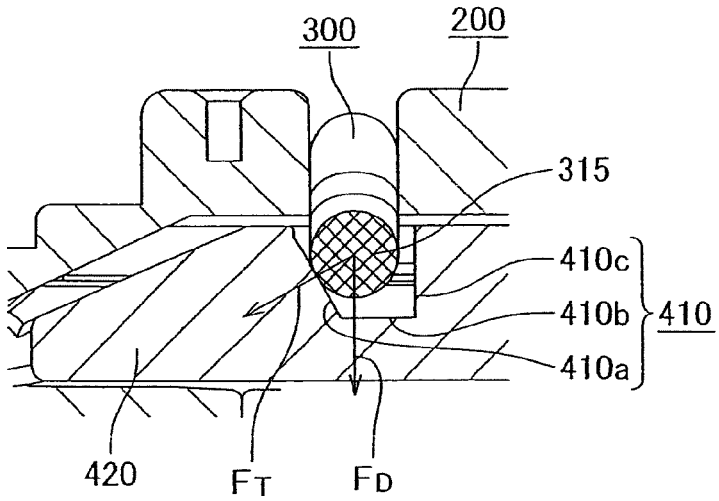
Figure 4C:
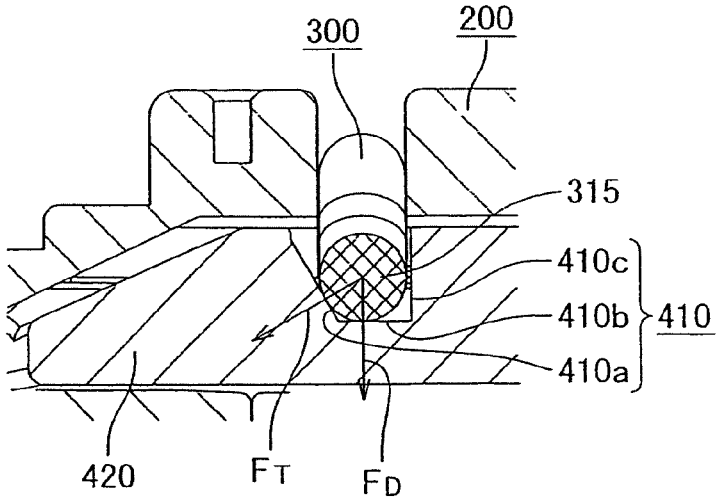

FIG. 4A shows a cross section of the female housing 200 and the male housing 400 mating with one another, each of which has a maximum permissible deviation during formation. FIG. 4B shows a state in which the female housing 200 and the male housing 400 of FIG. 4A have changed over time. FIG. 4C shows a cross section of the female housing 200 and the male housing 400 mating with one another, each of which has a minimum deviation during formation.

As shown in FIG. 4A, the fixing slit 410 is formed from an inclined plane 410*a*, a bottom 410*b*, and an upstanding wall 410*c*.

As shown in FIG. 4A, in a state where the deviation of each housing during formation is at a maximum within a permissible range, the latch part 315 of the latch metal 300 projecting from the opening portions 222 of the female housing 200 is made to contact the inclined plane 410*a* of the fixation slit 410.

In this case, force FT and elastic force FD are applied between the latch part 315 of the latch metal 300 and the inclined plane 410*a*. As a result, force is applied in a direction in which the latch part 315 moves in a direction from the inclined plane 410*a* toward the bottom 410*b*, and the female housing 200 and the male housing 400 are completely fixed to one another.

Further, as shown in FIG. 4B, the fixation slit 410 is provided such that the latch part 315 of the latch metal 300 projecting from the opening portion 222 of the female housing 200 contacts the inclined plane 410*a* of the fixation slit 410 even when: the deviation during formation is at a maximum within a permissible range; and then the housings are changed over time.

In this case, in the same way as in FIG. 4A, force FT and elastic force FD are applied between the latch part 315 of the latch metal 300 and the inclined plane 410*a*. As a result, force is applied in a direction in which the latch part 315 moves in a direction from the inclined plane 410*a* toward the bottom 410*b*, and the female housing 200 and the male housing 400 are completely fixed to one another even when the female housing 200 and the male housing 400 are changed in their shapes due to a change over time or the like (for example, a creep phenomenon).

Moreover, as shown in FIG. 4C, the fixation slit 410 is provided such that, when the deviation during the formation is at a minimum, the latch part 315 of the latch metal 300 projecting from the opening portion 222 of the female housing 200 is made to contact not only the inclined plane 410*a*, but also the bottom 410*b* of the fixation slit 410.

In this case, in the same way as in FIGS. 4A and 4B, force FT and elastic force FD are applied between the latch part 315 of the latch metal 300 and the inclined plane 410*a*. As a result, force is applied in a direction in which the latch part 315 moves in a direction from the inclined plane 410*a* toward the bottom 410*b*, and the female housing 200 and the male housing 400 are completely fixed to one another.

Next, FIG. 5 is a schematic view for explanation of the slit ribs 205*a*, 205*b*, 205*c*, and 205*d* of the female housing 200, and the slits 405*a*, 405*b*, 405*c*, and 405*d* of the male housing 400.

Figure 5A:
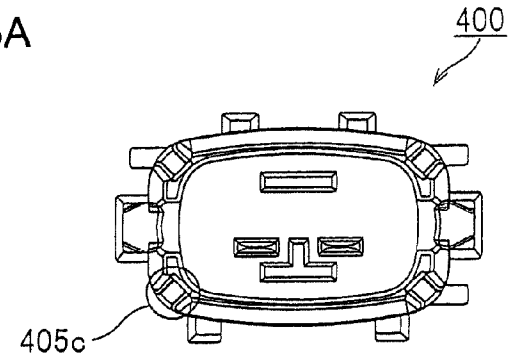
FIGS. 5A-5D are schematic views or explanation of slit ribs in the female housing and slits in the male housing.
Figure 5B:
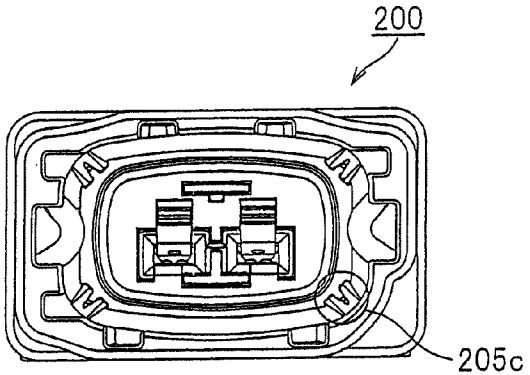
Figure 5C:
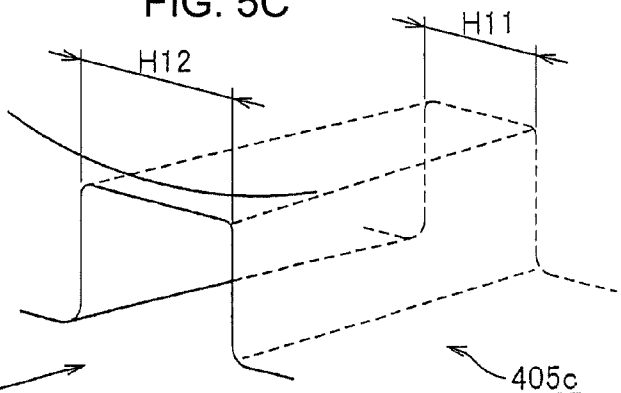
Figure 5D:
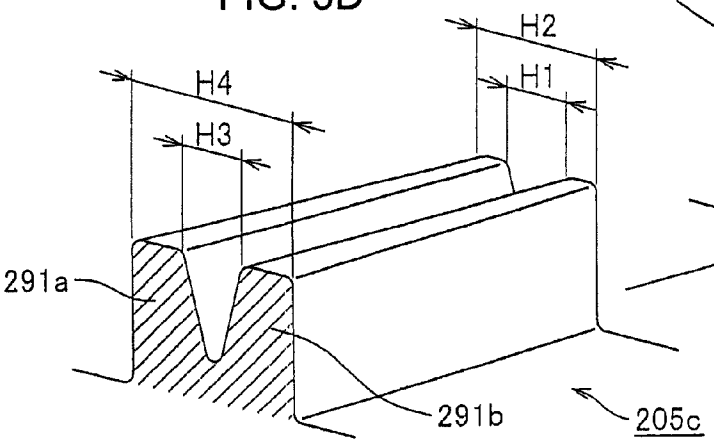

FIG. 5A shows a mating face of the male housing 400, FIG. 5B shows a mating face of the female housing 200, FIG. 5C shows a schematic perspective view of the slit 405*c*, and FIG. 5D shows a schematic appearance of the slit rib 205*c*.

In FIG. 5, the slit rib 205*c* among the slit ribs 205*a*, 205*b*, 205*c*, and 205*d* of the female housing 200 (refer to FIG. 5B), and the slit 405*c* among the slits 405*a*, 405*b*, 405*c*, and 405*d* of the male housing 400 (refer to FIG. 5A) are extracted for explanation. In addition, the slit ribs 205*a*, 205*b*, 205*c*, and 205*d* are formed into the same shape, and the slits 405*a*, 405*b*, 405*c*, and 405*d* as well are formed into the same shape.

As shown in FIG. 5C, the slit rib 205*c* is formed from two of a rib shape 291*a* and a rib shape 291*b*. The rib shapes 291*a* and 291*b* of the slit rib 205*c* are formed with a slit width H1 and a rib width H2 at the front edge side, and are formed with a slit width H3 and a rib width H4 at the back side of the rib.

Further, as shown in FIG. 5D, the slit 405*c* is formed with a slit entrance width H12 and a slit-back width H11.

A value (H2−H1) that the slit width H1 is subtracted from the rib width H2 becomes a value corresponding to the slit-back width H11 (refer to FIG. 5C), and a value (H4−H3) that the slit width H3 is subtracted from the rib width H4 becomes a value corresponding to the slit entrance width H12 (refer to FIG. 5C).

In this way, at the time of mating of the female housing 200 and the male housing 400, the front edge side of the slit rib 205*c* is inserted in a state of being pressure contacted by the slit width H1 at the back side of the slit 405*c*.

Further, at the time of mating of the female housing 200 and the male housing 400, the back side of the slit rib 205*c* is inserted in a state of being pressure contacted by the slit width H3 at the entrance side of the slit 405*c*.

In accordance with the above description, because the slit rib 205*c* is made to be pressure contacted by the slit width at the slit 405*c*, mating of the female housing 200 and the male housing 400 is reliably and firmly carried out.

Next, FIG. 6 is a schematic explanatory diagram showing one example of details of the slits 250*a*, 250*b*, 250*c*, and 250*d* of the female housing 200, and the ribs 450*a*, 450*b*, 450*c*, and 450*d* of the male housing 400. In FIG. 6, the slit 250*d* and the rib 450*d* will be described.

Figure 6A:
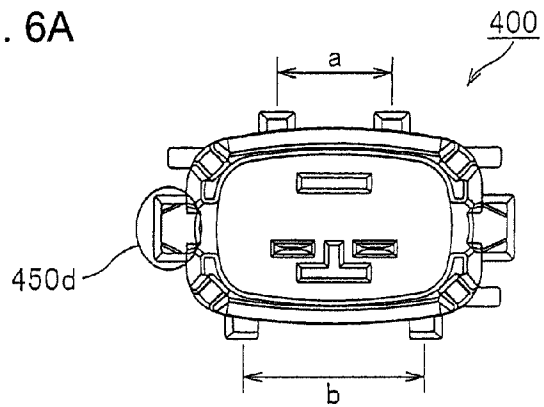
FIGS. 6A-6D are schematic explanatory diagrams showing one example of details of slits of the female housing and ribs of the male housing.
Figure 6B:
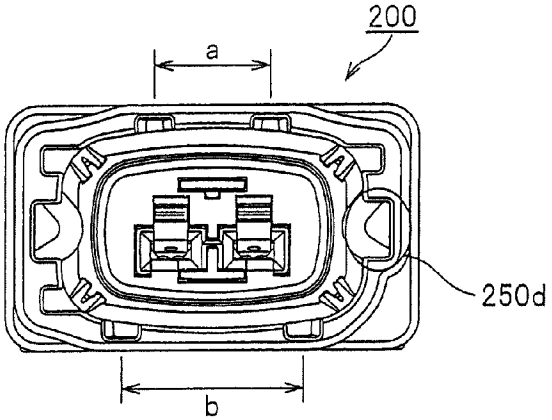
Figure 6C:
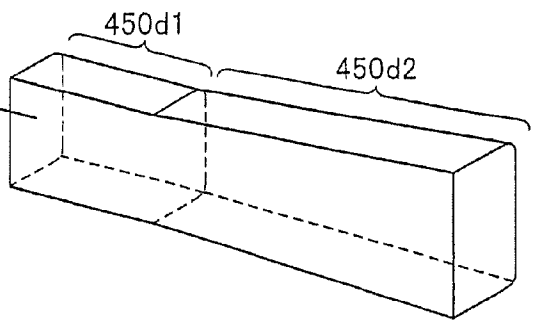
Figure 6D:
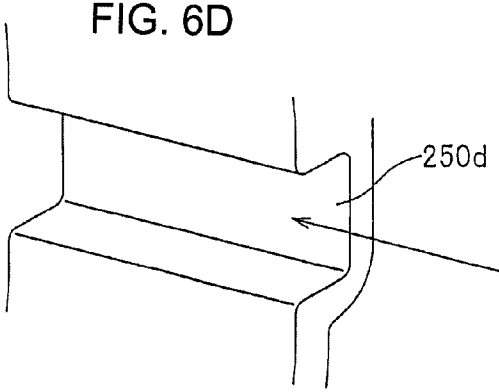

FIG. 6A shows a mating face of the male housing 400, FIG. 6B shows a mating face of the female housing 200, FIG. 6C shows a schematic appearance of the rib 450*d*, and FIG. 6D shows a schematic appearance of the slit 250*d*.

As shown in FIG. 6C, the rib 450*d* of the male housing 400 is formed from a rib 450*d*1 composed of a square pole and a rib 450*d*2 whose rib shape becomes gradually greater. The rib 450*d*2 has a shape (a square pyramid) becoming greater in both of the horizontal and vertical directions of the rib 450*d*.

As a result, when the rib 450*d*1 is started mating with the slit 250*d* of FIG. 6D, there is a space between the both. In contrast thereto, when the rib 450*d*2 is started mating with the slit 250*d*, the rib 450*d*2 contacts therein, and there is no space between the rib 450*d* and the slit 250*d*, which makes the both mate with one another firmly.

Further, as shown in FIGS. 6A and 6B, a pitch a between the ribs 450*a* and 450*b* of the male housing 400, and a pitch b between the ribs 450*e* and 450*f* are different values, and the tapered shapes of the ribs 450*a* and 450*b* and the ribs 450*e* and 450*f* are formed at completely different angles of inclination. As a result, it is possible to reliably prevent inverse-mating of the male housing 400 and the female housing 200.

Next, FIG. 7 is a schematic view showing relationships between the rectangular slit 402 and the T-slit 403 of the male housing 400 and the rectangular rib 202 and the T-rib 203 of the female housing 200. FIG. 7A shows the rectangular rib 202 and the T-rib 203 of the female housing 200, FIG. 7B shows the rectangular slit 402 and the T-slit 403 of the male housing 400, FIG. 7C shows another example of the rectangular rib 202 and the T-rib 203 of the female housing 200, and FIG. 7D shows yet another example of the rectangular rib 202 and the T-rib 203 of the female housing 200.

Figure 7A:
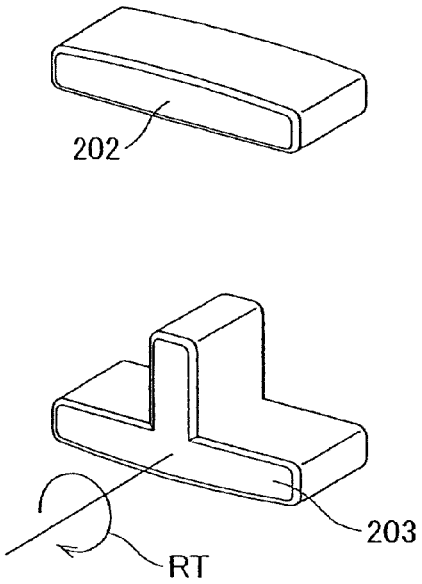
FIGS. 7A-7D are schematic views showing relationships between a rectangular slit (a recess in the shape of rectangle) and a T-slit (a recess in the shape of "T") of the male housing and a rectangular rib and a T-rib of the female housing.
Figure 7B:
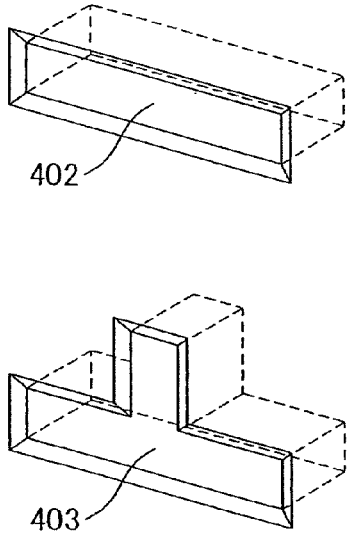

As shown in FIGS. 7A and 7B, in a relationship between the T-rib 203 and the T-slit 403, it is possible to reduce an error in a direction of an arrow RT in the drawing. That is, it is possible to reduce an error in the direction of the arrow RT by a right-angle rib action of the T-rib 203.

Figure 7C:
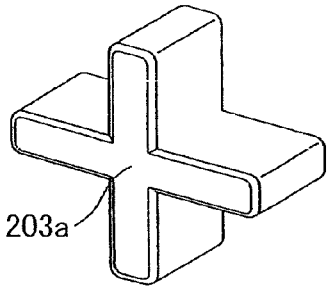
Figure 7D:
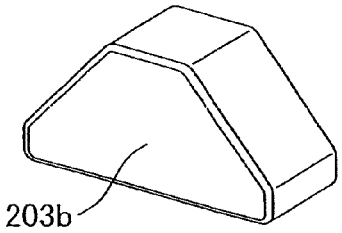

Further, as shown in FIG. 7C, a cross rib 203*a* may be used in place of the T-rib 203, and as shown in FIG. 7D, a trapezoidal rib 203*b* may be used in place of the T-rib 203. In these cases as well, it is possible to reduce an error in the direction of the arrow RT in the drawing in the same way as the relationship between the T-rib 203 and the T-slit 403.

In addition, in the present embodiment, the T-rib 203, the T-slit 403, the cross rib 203*a*, a cross slit (not shown), the trapezoidal rib 203*b*, and a trapezoidal slit (not shown) have been shown as examples. However, these are not limited, and any other shape of a rib and a slit may be used.

Figure 8B:
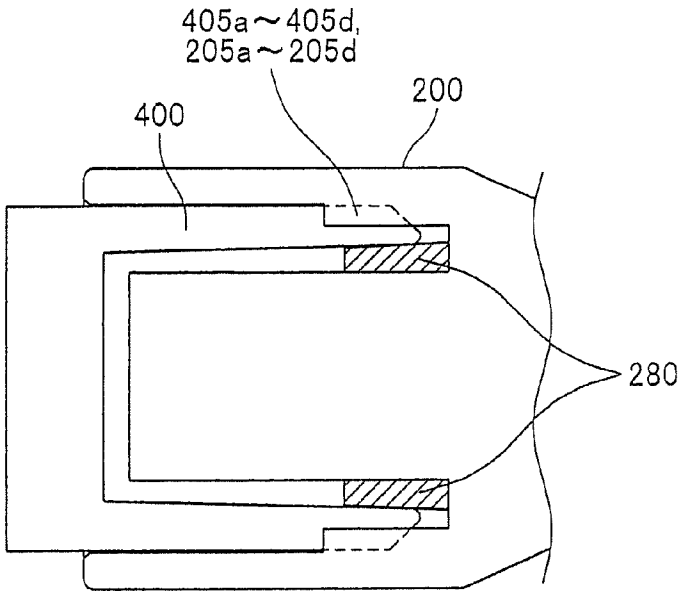
FIGS. 8A-8B are schematic explanatory diagrams for explanation of backlash preventing ribs in the female housing.
Figure 8A:
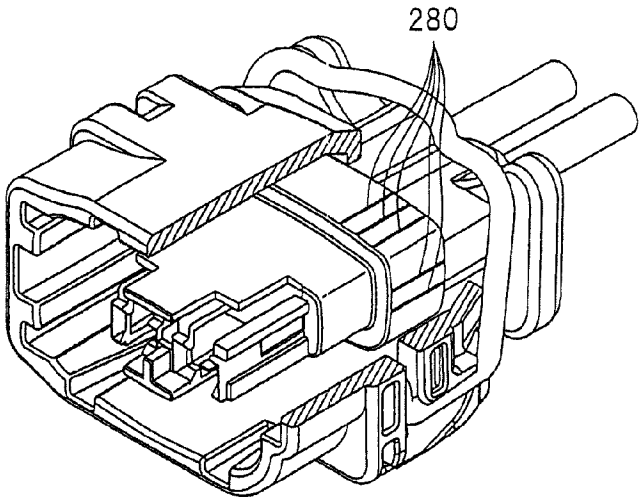

Next, FIG. 8 is a schematic explanatory diagram for explanation of backlash preventing ribs 280 of the female housing 200. FIG. 8A is a perspective view that a part of the female housing 200 is notched, and FIG. 8B is a view schematically showing a cross section of FIG. 8A.

First, as shown in FIG. 8A, the backlash preventing ribs 280 are provided inside the female housing 200. The backlash preventing ribs 280 are provided so as to be able to prevent the mating of the female housing 200 and the male housing 400 from rattling to an excessive degree when an excessive vibration is applied.

That is, as shown in FIG. 8B, in contrast to that the slit ribs 205*a* to 205*d* and the slits 250*a* to 250*i* of the female housing 200 maintain the mating by applying pressure from the outside to the inside of the outer shape of the male housing 400, the backlash preventing ribs 280 are to prevent rattling due to excessive vibration. Accordingly, a clearance may be provided when the male housing 400 is made to mate with the female housing 200.

As described above, in the electrical connector 100 according to the present embodiment, when the slit ribs 205*a* to 205*d* of the female housing 200 are inserted into the tapered shapes of the slits 405*a* to 405*d* of the male housing 400, and because a rate of angular change and a rate of width change of the slits 405*a* to 405*d* are greater than a rate of angular change and a rate of width change of the slit ribs 205*a* to 205*d*, a state in which force is always applied between the slits 405*a* to 405*d* and the slit ribs 205*a* to 205*d* is brought about. That is, the slit widths H1 and H3 of the slit ribs 205*a* to 205*d* become narrower to be inserted into the corresponding slits 405*a* to 405*d*. In accordance therewith, because force is applied in a direction in which the slit widths H11 and H12 are increased, the female housing 200 and the male housing 400 are fixed firmly. Moreover, because the mating faces between the slits 405*a* to 405*d* and the slit ribs 205*a* to 205*d* are formed into tapered shapes, it is possible to reduce the insertion force at the time of mating.

As a result, it is possible to make the female housing 200 and the male housing 400 rigid reliably, and it is possible to prevent vibration between the female housing 200 and the male housing 400 even in an environment of high-acceleration vibration. Accordingly, it is possible to suppress abrasion between the female housing 200 and the male housing 400, and to reliably keep the connections between the first joining terminals 201*a* and 201*b* and the second joining terminals 401*a* and 401*b*.

Further, by forming the slits 405*a* to 405*d* on the corner portions of the rectangular shape of the male housing 400, and forming the slit ribs 205*a* to 205*d* on the corner portions of the female housing 200, it is possible to prevent a deviation in a direction of rotation centering on the direction of mating, and it is possible to enhance the strength of the female housing 200 and the male housing 400 from the standpoint of forming.

Moreover, due to the cross sections of the female housing 200 and the male housing 400 being formed into rectangular shapes, it is possible to prevent a deviation in a direction of rotation centering on the direction of mating of the female housing 200 and the male housing 400. As a result, the female housing 200 and the male housing 400 are fixed to be coupled, and it is possible to prevent a deviation in the joining between the female housing 200 and the male housing 400 even in an environment resistant to high-acceleration. Accordingly, it is possible to prevent abrasion among the joining terminals 201*a*, 201*b*, 401*a*, and 401*b* of the female housing 200 and the male housing 400.

Moreover, at the time of mating of the female housing 200 and the male housing 400, due to not only the mating of the slits 405*a* to 405*d* and the slit ribs 205*a* to 205*d*, but also to the mating of the slits 250*a*, 250*b*, 250*c*, and 250*d* and the ribs 450*a*, 450*b*, 450*c*, and 450*d*, the female housing 200 and the male housing 400 are further fixed to be coupled, which makes it possible to prevent a deviation in the joining between the female housing 200 and the male housing 400 even in an environment resistant to high-acceleration. Accordingly, it is possible to reliably prevent abrasion among the joining terminals of the female housing 200 and the male housing 400.

Further, because a distance a between the pair of slits 250*a* and 250*b* and a distance b between the pair of slits 250*c* and 250*d* are different from one another, it is possible to further prevent inverse-mating of the female housing 200 and the male housing 400.

Further, because the rectangular rib 202 and the T-rib 203 are formed in the vicinity of the positions at which the first joining terminals 201*a* and 201*b* are installed, it is possible to suppress vibration in a direction of rotation (direction of torsion) centering on the direction of the mating of the female housing 200 and the male housing 400. As a result, it is possible to reliably prevent abrasion among the first joining terminals 201*a* and 201*b* of the female housing 200 and the second joining terminals 401*a* and 401*b* of the male housing 400.

Further, at the time of mating of the male housing 400 and the female housing 200, the latch parts 315 of the latch metal 300 locked onto the guide ways 210 of the female housing 200 project toward the male housing 400 side from the opening portions 222 of the female housing 200. Accordingly, the latch parts 315 respectively pass beyond the projection shaped parts 420 to be fixed into the fixation slits 410. Therefore, even when the mating of the female housing 200 and the male housing 400 is changed due to a change over time, because these are locked at the inclined planes 410*a* of the fixation slits 410, it is possible to continue to lock the latch parts 315 by a distance corresponding to the length of the inclined planes 410*a*. Accordingly, it is possible to cancel out an effect caused by an error or a permissible dimensional deviation. As a result, the electrical connector 100 can maintain the integrity for a long time even when there is an error or a permissible dimensional deviation, and can provide stable continuity for a long time.

In the electrical connector 100 according to the present embodiment, the first joining terminals 201*a* and 201*b* each corresponds to the first joining terminal, the female housing 200 corresponds to the female-type first housing, the second joining terminals 401*a* and 401*b* each corresponds to the second joining terminal, the male housing 400 corresponds to the male-type second housing, the guide ways 210 each corresponds to the groove formed in the first housing, the latch metal 300 corresponds to the latch metal, the slit ribs 205*a*, 205*b*, 205*c*, and 205*d* correspond to the slit ribs, the slits 405*a*, 405*b*, 405*c*, and 405*d* correspond to the slits, and the slits 250*a* to 250*i* correspond to the plurality of recessed slits, and the ribs 450*a* to 450*i* correspond to the projection shapes, the T-rib 203 corresponds to the rib shape including at least one of a cross shape, a T-shape, and a trapezoidal shape, the latch parts 315 each corresponds to the projection shaped latch part, the opening portions 222 each corresponds to the opening portion from which the latch part is capable of projecting, and the inclined planes 410*a* each corresponds to the predetermined inclined plane.

In addition, in the present embodiment, the case in which the female housing 200 is made to mate with the male housing 400 while the latch metal 300 is kept in a preload state by providing the guide ways 210 to the female housing 200 has been described. However, these are not limited, and guide ways may be provided to the male housing 400, and the latch metal 300 may be kept in a preload state.

Further, the shapes of the guide ways 210 and the latch metal 300 are not limited to these in the present embodiment, and latch metal 300 may have any shape which creates a preload state.

Moreover, in the present embodiment, the electrical connector 100 has two poles. However, these are not limited, and any other number of poles may be provided thereto. For example, the first joining terminals supported by the first housing and the second joining terminals supported by the second housing are not be necessarily provided in pairs, and a plurality of the first joining terminals and the second joining terminals may be appropriately provided.

Further, the latch parts 315 of the latch metal 300 are provided in a pair. However, these are not limited, and any other number of latch parts may be provided thereto. Moreover, the latch metal 300 may be composed of a plurality of members.

Moreover, the electrical connector 100 in the present embodiment can be used as a connector not only in the vicinity of a power source generating high-acceleration vibration, but also in any other optional use environment. For example, by optimally selecting materials for the female housing and the male housing which are described later, the durability, the weather resistance, the waterproof property, and the like are provided to a connector, which makes it possible for the connector to be used as another connecter in all environments.

The invention claimed is:

1. A connector, comprising:

a female-type first housing supporting a first joining terminal;

a male-type second housing supporting a second joining terminal electrically connected to the first joining terminal, the second housing being inserted into the first housing to mate with the first housing; and a latch metal, which is an elastic member, latched into a groove which extends in one direction perpendicular to a direction of mating of the first housing and the second housing and is formed in the first housing, the latch metal having a projection shaped latch part which is urged against the second housing in a direction perpendicular to both of the direction of mating and a direction of the groove, wherein:

the first housing has, in the groove, an opening portion from which the latch part is capable of projecting toward the second housing for locking;

the second housing has a projection shaped part formed thereon, and a fixation slit formed in a direction parallel to the direction of the groove;

the fixation slit has a predetermined inclined plane which locks, at the time of mating of the first housing and the second housing, the latch part projecting from the opening portion of the first housing;

the latch metal is configured so that, at the time of mating of the second housing with the first housing, the latch part projects from the opening portion and contacts the predetermined inclined plane due to elastic force;

the latch part projecting from the opening portion passes beyond the projection shaped part and then is locked at the predetermined inclined plane, at the time of mating of the first housing and the second housing;

the first housing has a slit rib formed from two rib shapes which are formed with a slit width H1 and a rib width H2 at the front edge side, and are formed with a slit width H3 and a rib width H4 at the back side of the rib;

the second housing has a tapered slit having a slit-back width H11 and a slit entrance width H12;

a value of H2 minus H1 corresponds to the slit-back width H11, and a value of H4 minus H3 corresponds to the slit entrance width H12; and at the time of mating of the female housing and the male housing, the front edge side of the slit rib is inserted in a state of being pressure contacted by the slit width H1 at the back side of the slit, and at the time of mating of the female housing and the male housing, the back side of the slit rib is inserted in a state of being pressure contacted by the slit width H3 at the entrance side of the slit.

2. The connector according to claim 1, wherein the predetermined inclined plane is configured so that, even when (i) the first housing and the second housing each has a maximum permissible dimensional deviation during formation thereof or (ii) the shapes of the first housing and the second housing are changed over time, the latch part projects from the opening portion and contacts the predetermined inclined plane due to elastic force, at the time of mating of the second housing with the first housing.

3. The connector according to claim 1 or 2, wherein the projection shaped part has a trapezoidal shape on cross section cut by a plane perpendicular to the direction of the groove.

4. The connector according to claim 1, wherein the fixation slit has a substantially V-shape in the direction parallel to the direction of the groove, and a first inclined side of the V-shape is formed at a different inclined angle than an inclined angle of a second inclined side of the V-shape.

5. The connector according to claim 4, wherein the first inclined angle facing in a direction of a top surface of the second housing is formed at an angle smaller than the second inclined angle.

* * * * *